US010314379B2

(12) United States Patent
Castex

(10) Patent No.: US 10,314,379 B2
(45) Date of Patent: Jun. 11, 2019

(54) MAKE-UP ITEM COMPRISING AN APPLICATOR AND A MAKE-UP PRODUCT DISPENSER

(71) Applicant: CHANEL PARFUMS BEAUTE, Neuilly sur Seine (FR)

(72) Inventor: Nicolas Castex, Colombes (FR)

(73) Assignee: Chanel Parfums Beaute, Neuilly sur Seine (FR)

( * ) Notice: Subject to any disclaimer, the term of this patent is extended or adjusted under 35 U.S.C. 154(b) by 105 days.

(21) Appl. No.: 15/512,198

(22) PCT Filed: Sep. 30, 2015

(86) PCT No.: PCT/FR2015/052614
§ 371 (c)(1),
(2) Date: Mar. 17, 2017

(87) PCT Pub. No.: WO2016/055718
PCT Pub. Date: Apr. 14, 2016

(65) Prior Publication Data

US 2017/0280853 A1 Oct. 5, 2017

(30) Foreign Application Priority Data

Oct. 7, 2014 (FR) ..... 14 59612

(51) Int. Cl.
*A46B 11/00* (2006.01)
*A45D 40/00* (2006.01)
(Continued)

(52) U.S. Cl.
CPC ..... *A45D 40/0075* (2013.01); *A45D 33/006* (2013.01); *A45D 33/02* (2013.01);
(Continued)

(58) Field of Classification Search
CPC ..... A46B 11/0006
(Continued)

(56) References Cited

U.S. PATENT DOCUMENTS 2,596,217 A * 5/1952 Dendy ..... A46B 11/0006 222/230
5,137,388 A 8/1992 Kimura
(Continued)

FOREIGN PATENT DOCUMENTS

EP 2687119 A2 1/2014
GB 403219 A 12/1933
(Continued)

OTHER PUBLICATIONS

International Search Report PCT/ISA/210 for International Application No. PCT/FR2015/052614 dated Dec. 8, 2015.
Russian Office Action dated Oct. 31, 2018 issued in corresponding Russian Application No. 2017107092/12(012339) (with English Translation).

*Primary Examiner* — David J Walczak
*Assistant Examiner* — Joshua R Wiljanen
(74) *Attorney, Agent, or Firm* — Harness, Dickey & Pierce, P.L.C.

(57) ABSTRACT

The make-up item including an applicator having application head defining an envelope surface, and a make-up product dispenser, which includes a site for receiving the applicator, and having an outer valve provided with at least one dispensing opening which faces a portion of the envelope surface when the applicator is received in the site, the valve being able to assume a closed position and an open position wherein the valve releases product directly against the head of the applicator.

8 Claims, 3 Drawing Sheets

Figure 1:
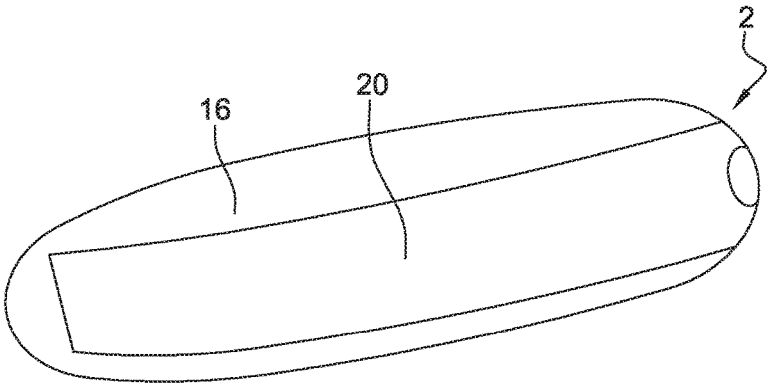

(51) Int. Cl.

| | |
|---|---|
| ***A45D 33/00*** | (2006.01) |
| ***A45D 33/02*** | (2006.01) |
| ***A45D 34/04*** | (2006.01) |
| ***A45D 40/22*** | (2006.01) |
| ***A45D 40/26*** | (2006.01) |

(52) U.S. Cl.
CPC ..... *A45D 33/025* (2013.01); *A45D 34/042* (2013.01); *A45D 40/22* (2013.01); *A45D 40/262* (2013.01); *A46B 11/0006* (2013.01); *A46B 2200/106* (2013.01); *A46B 2200/1053* (2013.01); *A46B 2200/1066* (2013.01)

(58) Field of Classification Search
USPC ..... 401/125–131, 191
See application file for complete search history.

(56) References Cited

U.S. PATENT DOCUMENTS

| | | | | |
|---|---|---|---|---|
| 6,942,412 | B2 * | 9/2005 | Gueret | A45D 34/045 401/123 |
| 2014/0001210 | A1 * | 1/2014 | Lim | A45D 33/006 222/162 |

FOREIGN PATENT DOCUMENTS

| | | | |
|---|---|---|---|
| RU | 2160028 | C2 | 12/2000 |
| WO | WO-9620622 | A1 | 7/1996 |
| WO | WO-2009/032443 | A1 | 3/2009 |
| WO | WO-2011/101999 | A1 | 8/2011 |

* cited by examiner

MAKE-UP ITEM COMPRISING AN APPLICATOR AND A MAKE-UP PRODUCT DISPENSER

CROSS-REFERENCE TO RELATED APPLICATIONS

This application is the U.S. National Phase application of PCT Application No. PCT/FR2015/052614 filed on Sep. 30, 2015, which claims priority to French Application No. 1459612 filed on Oct. 7, 2014, the contents of each of which are incorporated herein by reference.

The invention relates to make-up items.

Make-up items having an applicator and a make-up product dispenser intended to deposit such product on the applicator are known. Traditionally, the dispenser includes a make-up product container, into which the applicator is dipped and becomes loaded with product. However, in most cases this configuration loads an excessive amount of product on the applicator, so it is therefore best to remove the surplus product to avoid wastage and to facilitate making up as such. Thus, it is known to equip the container with a wiper intended to remove the excess product, some of which then falls back into the container.

However, the presence of a wiper generally creates certain problems. The applicator is loaded with product by dipping, a wiper retains the product which is on the surface of the applicator. The product which is towards the center of the applicator, in other words near the rod, is not wiped. Nor is it deposited on the eyelashes. This product dries over time.

A wiper does not allow optimized dosing of product on the applicator. A soft wiper provides effective wiping of the applicator but it does not guide it efficiently when extracting it from a vial. Thus, depending on the angle given to the applicator, some surface areas are more or less well wiped, in other words wiping is not uniform over the surface of the applicator, nor is it repetitive.

Due to the wiper, the applicator is subject to geometrical constraints. An applicator has a free end which is tapered to facilitate its passage through the wiper when inserted in the vial. This tapered shape offers no particular benefit for the make-up result.

In addition, the wiper creates a phenomenon generally called swabbing. When introducing or extracting the applicator into/out of the vial, the movement of the applicator creates a depression or an overpressure in the vial which hinders its free movement. To mitigate the effect produced by these pressure variations, a volume of free air must be provided between the product and the vial. Thus, when filling, the vial is not completely filled with product so as to keep a volume of air. It is therefore necessary to design a vial whose inner volume is greater than the volume of product which is initially contained.

An object of the invention is to avoid or at least reduce wastage of make-up product, due to depositing an excessive amount of product on the applicator and to drying of the product exposed to air.

The invention therefore relates to a make-up item which comprises:

- an applicator whose application head defines an envelope surface, and
- a make-up product dispenser, comprising a site for receiving the applicator, and having at least one outer valve provided with at least one dispensing opening which faces a portion of the envelope surface when the applicator is received in the site, the valve being able to assume a closed position and an open position wherein the valve releases product directly against the head of the applicator.

Thus, the outer valve efficiently controls the area of the applicator where the product is dispensed. It can also be used to control the amount of product dispensed, and therefore to ensure that the dispenser releases only the required amount product against the applicator in a specific area of the applicator. In addition, after releasing the product, the valve closes to protect, from the air, the amount of make-up product supplied by the valve but which has not been released against the applicator. This prevents the product which has not been released from being exposed to the air and therefore the formation of a residue of dried product.

Advantageously, the valve opens and closes at the dispensing openings.

This provides optimum control over the amount of product dispensed on the applicator and minimizes the amount of product which, after dispensing, is exposed to the air.

Advantageously, the valve is arranged so that when in the closed position, the valve is located away from the applicator received in the site.

Thus, since the applicator received in the site is located at a non-zero distance from the valve when the valve is closed, the risks of damaging the applicator and the valve, in particular by friction or shock, are reduced.

Advantageously, the dispenser further comprises a flexible pouch for storing the make-up product, this flexible pouch being housed in a rigid container mounted movably relative to the valve.

Due to the arrangement of the flexible pouch and the container in the dispenser, the valve can be easily supplied with make-up product.

Preferably, the dispenser further comprises a return spring capable of bringing the container from a near position, in which the container is near to the valve, to a remote position, in which the container is remote from the valve.

Part of the container displacement during operation is therefore carried out automatically, thereby limiting the forces to be provided by a user of the make-up item.

Advantageously, the dispenser further comprises a pump, without air intake, for supplying the valve with make-up product.

This pump efficiently supplies the valve with make-up product, preventing the product from being discharged in the dispenser, which would otherwise occur when using a traditional pump.

Advantageously, the dispenser further comprises a outer member for controlling the valve, this control member being associated with a stop for controlling the supply of the valve with make-up product.

The control member allows the user of the item to easily supply the valve with make-up product. The control stop provides a simple means of delivering the necessary and sufficient amount of product to the valve, and therefore to the applicator.

According to a first embodiment of the invention, the item further comprises a channel adapted to be filled with make-up product, and the valve is formed by at least one elastic wall closing the channel, the wall having the dispensing opening, and the channel comprising at least one blocking relief arranged so that it blocks the opening when the valve is in the closed position.

According to a second embodiment of the invention, the item further comprises a channel adapted to be filled with make-up product, and the valve is formed by at least two upper and lower elastic walls, superimposed but spaced apart, the upper wall having the dispensing opening and the lower wall having at least one internal opening and at least one blocking relief arranged so that it blocks the dispensing opening when the valve is in the closed position.

In each of these embodiments, the valve design is simple.

Preferably, the wall(s) are arranged so that they deform to open the valve under the sole pressure of the make-up product filling the channel.

There is therefore no need to provide an additional member to open and close the valve, which would increase the cost and take up more space in the dispenser.

The invention also provides a method for depositing a make-up product on a make-up applicator using a product dispenser, wherein:

make-up product is released directly against an application head of the applicator, by opening an outer dispenser valve supplied with make-up product, and the valve is closed.

Figure 2:
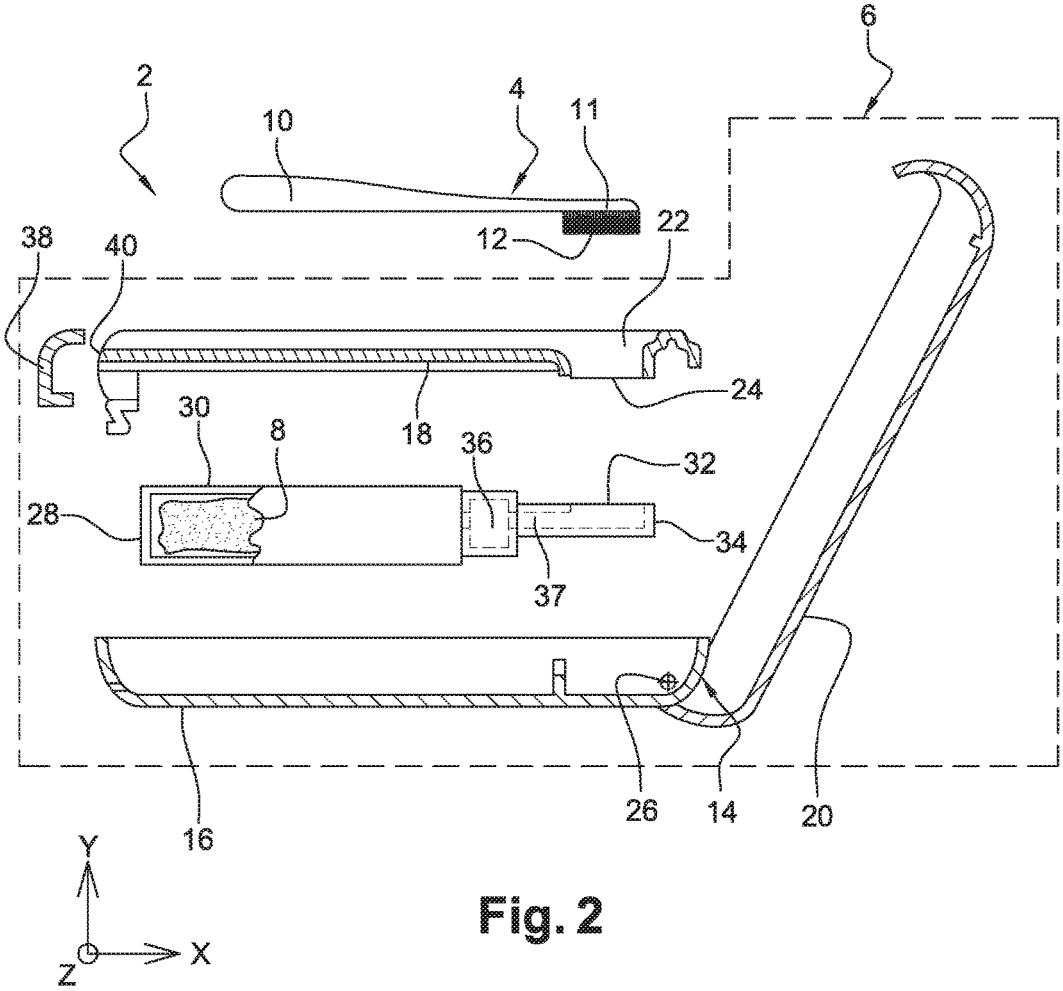
Figure 3:
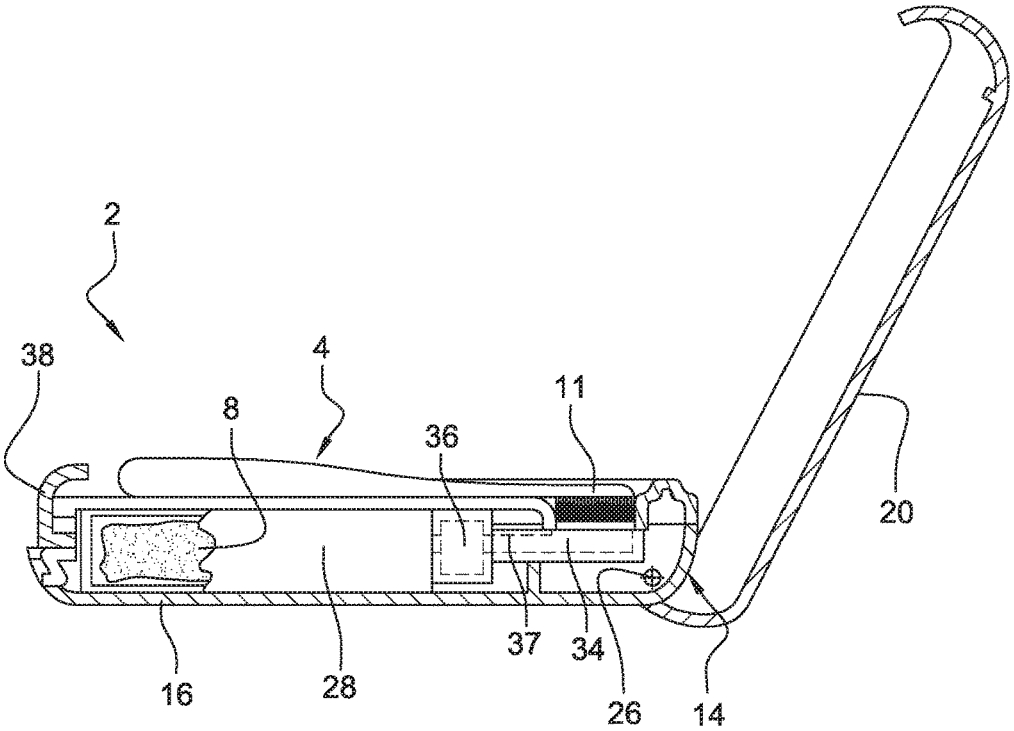
Figure 4:
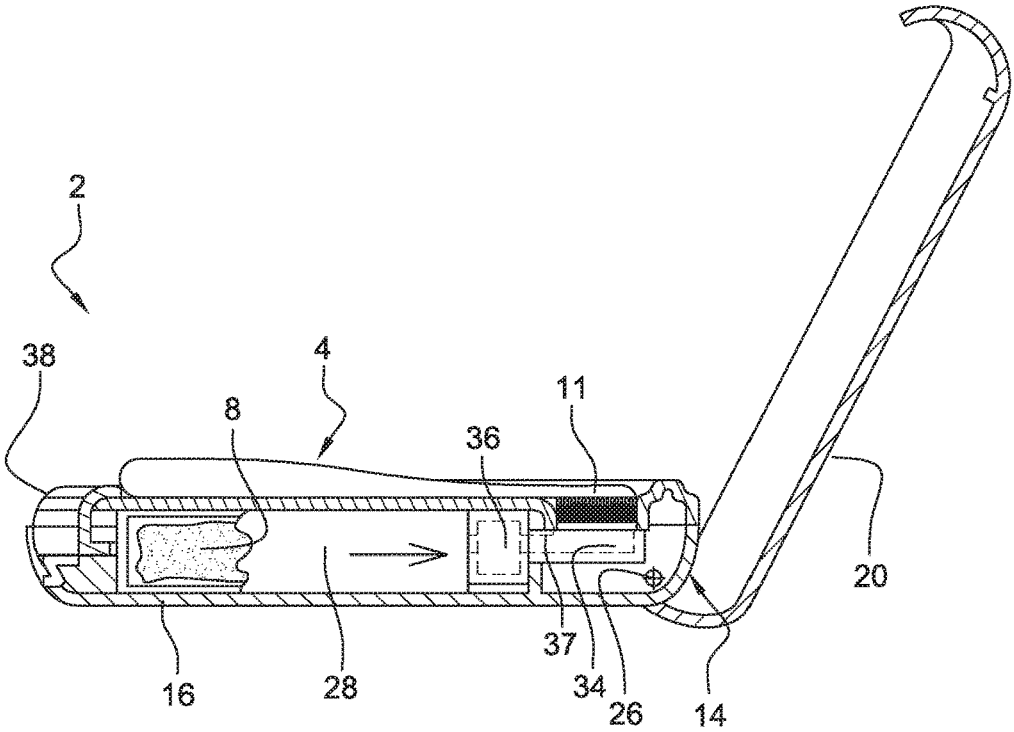
Figure 5:
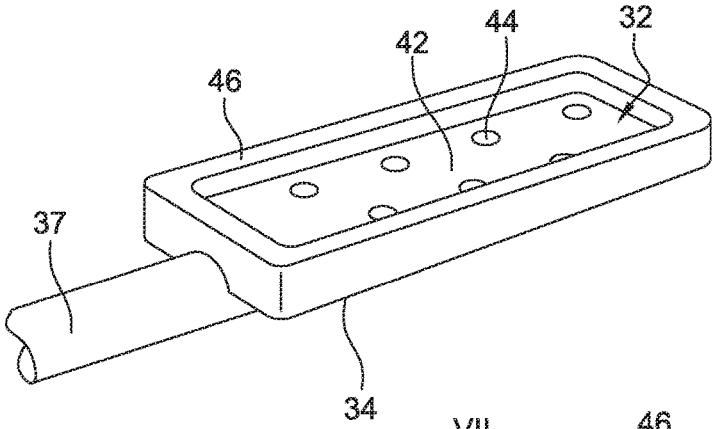
Figure 6:
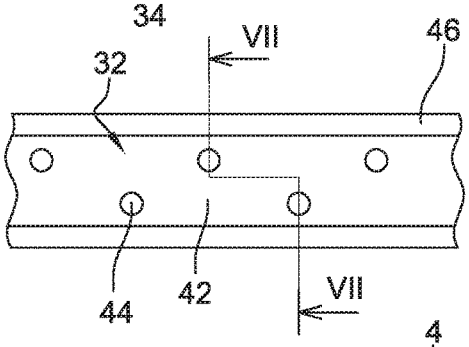
Figure 7:
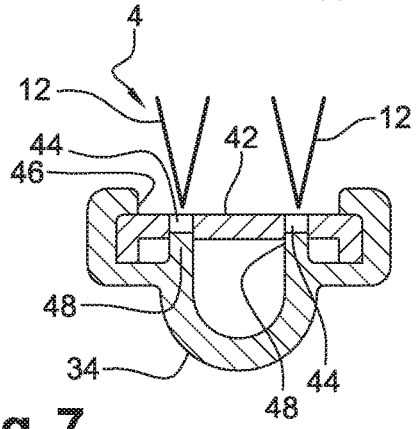
Figure 8:
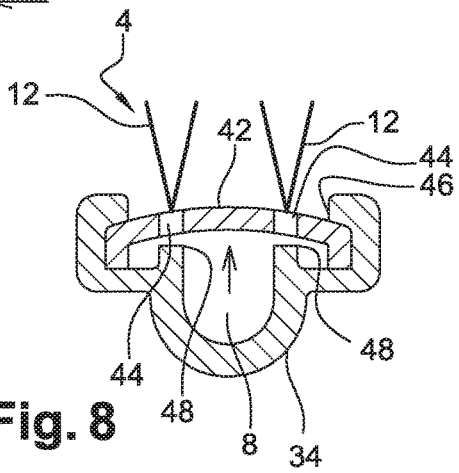
Figure 9:
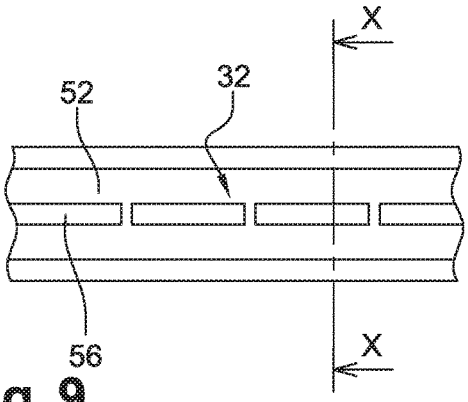
Figure 10:
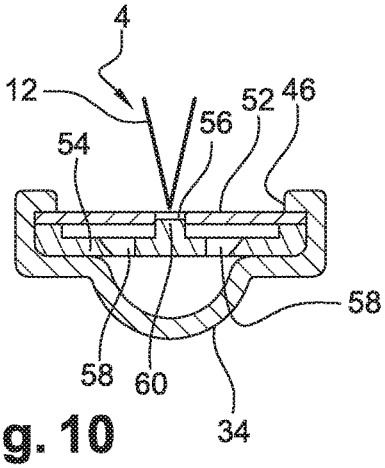

We will now describe the embodiments of the invention using the attached drawings, in which:

FIG. 1 is a general view of a make-up item according to one embodiment of the invention, FIG. 2 is an exploded view in longitudinal cross-section of the item of FIG. 1, FIGS. 3 and 4 are longitudinal cross-sectional views of the make-up item of FIG. 1, illustrating respectively remote and near positions of a container of the item of FIG. 1, FIGS. 5 and 6 illustrate a channel and a valve of the make-up item of FIG. 1 according to a first embodiment of the invention, FIGS. 7 and 8 are cross-sectional views along VII-VII of the channel and of the valve of FIG. 6, in two different positions of the valve, FIG. 9 illustrates a channel and a valve of the make-up item of FIG. 1 according to a second embodiment of the invention, and FIG. 10 is a cross-sectional view along X-X of the channel and of the valve of FIG. 9.

FIGS. 1 and 2 illustrate a make-up item 2 according to a first embodiment of the invention. This item 2 comprises an applicator 4 and a dispenser 6 of make-up product 8. This product 8 is for example mascara, but any other make-up product could be used, such as gloss, lipstick or nail polish, or generally any cosmetic or perfumery product.

In this case, the applicator 4 consists of a rod 10 with teeth or protrusions 12 at one of its ends forming an applicator head 11, so that the applicator 4 is comb-like. The application head 11 defines an envelope surface of the applicator 4. Generally, the applicator 4 could belong to at least one of the following categories: injected brush, brush and comb. The applicator 4 could also have a different shape, including the shape of a paintbrush or of a rigid or flexible palette.

The dispenser 6 comprises a unit 14 forming a housing 16, an intermediate lid 18 partially closing the housing 16, and an external lid 20 completely closing the housing 16 and covering the intermediate lid 18. The latter has a site 22 for receiving the applicator 4, as well as a communication opening 24 between the outside of the dispenser 6 and the inside of the unit 14, formed opposite the head 11 of the applicator 4, and only thereof, when it is received in the site 22. We will see below that this geometry is interesting for the operation of the item 2.

The intermediate lid 18 is attached to the housing 16 and stationary relative thereto, whereas the external lid 20 is mounted movably in rotation relative to the housing 16 about an axis of rotation 26, so that the unit 14 can be opened and closed. However, any other system for closing the unit 14 could be provided.

The dispenser 6 further comprises a flexible pouch 30 for storing the make-up product 8, this flexible pouch 30 being housed in a rigid container 28 located in the housing 16, with respect to which it is mounted movably by sliding along the X direction in the orthogonal coordinate system shown on FIG. 2, this direction being in this case the longitudinal direction of item 2.

The dispenser 6 also comprises an outer valve 32 which can assume a closed position in which the valve is located remote from the applicator 4 received in the site 22, and an open position in which the valve 32 releases product 8 directly against the head 11 of the applicator 4 received in the site 22. In its closed position, the valve 32 could be in contact with the applicator 4. The valve 32 is stationary relative to the housing 16 and the intermediate lid 18, so that the rigid container 28 is mounted movably by sliding along the X direction relative to the valve 32.

The dispenser 6 also comprises a channel or chute for supplying product 34 from the valve 32. The valve 32 is located opposite the communication opening 24 of the intermediate lid 18. The valve 32 and the channel 34 will be described in more detail below.

The dispenser 6 further comprises a pump 36, without air intake, for supplying the valve 32 with make-up product 8. The pump 36 is connected to the flexible pouch 30 and is in fluid communication with the product 8. The pump is attached to the container 28, so that it follows the displacements of the container. Since pumps without air intake are known, the operation of the pump 36 will not be described here. It is intended to pump product 8 from the pouch 30 to the channel 34, via a supply duct 37. The channel 34 is of the kind adapted to be filled with make-up product 8. The container 28 and the pouch 30 could be mounted in the unit 14 and could be removably connected to the pump 36 in order to replace the container 28 when empty with a new container.

The dispenser 6 also comprises an external member 38 for controlling the valve 32, consisting of a push-button. This control member 38 is mounted movably by sliding along the X direction relative to the housing 16 and is associated with a stop 40 for controlling the supply of the valve 32 with make-up product 8. A free surface of the push-button 38 is formed on an outer surface of the dispenser 6, so that the push-button 38 can be actuated by a user. The push-button 38 is arranged so that it drives the container 28 in its movement towards the valve 32.

The dispenser 6 comprises no wiper.

Further details concerning the mechanism of the dispenser can be found in document EP-2687119, reference being made to this document herein.

We will now describe how the make-up product 8 is routed from the flexible pouch 30 to the outer valve 32.

FIG. 3 illustrates item 2 in a configuration such that the applicator 4 is received in the site 22 and ready to receive product 8. The push-button 38 has not yet been pressed by the user, and the container 28 presses against the push-button 38. In this case, the container 28 is in a remote position in which it is remote from the outer valve 32.

Referring to FIG. 4, we assume that a user presses the push-button 38 towards the valve 32, in other words to the right when considering the orientation of FIGS. 3 and 4. In its displacement, the push-button 38 moves the container 28 and the flexible pouch 30 towards the pump 36. The container 28 therefore approaches the valve 32, and when the push-button 38 comes into contact with the control stop 40, the container 28 assumes a position near the valve 32.

During the displacement of the container 28 between the remote and near positions, a predetermined dose of product 8 is extracted from the flexible pouch 30 by the pump 36 to fill the channel 34 via the duct 37 and therefore supply the valve 32. The amount of product 8 contained in the predetermined dose depends on the position of the control stop 40, since it determines the stroke of the push-button 38, and therefore also that of the container 28 in the unit 14. The shape or length of the stop 40 can therefore be adjusted when designing the dispenser 6 in order to adjust the amount of product 8 contained in the predetermined dose.

Once the push-button 38 is in contact with the stop 40, the dose of product 8 is extracted from the flexible pouch 30 to supply the valve 32. The user can now release the push-button 38. A return spring (not shown on the figures) located in the unit 14 then pushes the container 28 away from the valve 32, taking with it the push-button 38. The container 28 therefore moves automatically from its near position to its remote position, and the dispenser 6 returns to the configuration illustrated on FIG. 3. In other words, the dispenser 6 comprises a return spring capable of bringing the container 28 from the near position, in which the container 28 is near the valve 32, to the remote position, in which the container 28 is remote from the valve 32. The amount of product dispensed is controlled by the stop 40, but a smaller amount can be dispensed if the user stops pressing the push-button 38 before it reaches the stop 40. It is also possible to increase the amount dispensed by releasing the pressure on the push-button 38 then pressing it again.

The valve 32 can therefore be supplied with make-up product 8.

We will now describe how the make-up product 8 is released directly against the applicator 4.

In the embodiment illustrated on FIGS. 5 to 8, the valve 32 consists of a flat elastic wall or membrane 42 closing the channel 34, the wall 42 having at least one dispensing opening 44. The dispensing opening(s) 44 are designed to dispense the product 8 locally against the envelope surface of the applicator 4. In this case, the wall 42 has several dispensing openings 44 of circular contour distributed in a staggered pattern. The channel 34 has a shoulder 46 used to attach the periphery of the wall 42 to the channel 34. The channel 34 also comprises at least one blocking relief 48, formed under the wall 42, arranged so that it blocks the openings 44 when the valve 32 is in the closed position. In this case, the channel 34 comprises one blocking relief 48 for each opening 44 in the wall 42. The dispensing openings 44 face a portion of the envelope surface when the applicator 4 is received in the receiving site 22. More precisely, the dispensing openings 44 are placed opposite the teeth or protrusions 12 against which product 8 is to be released.

When the dispenser 6 is not used, in other words when the push-button 38 is not pressed, the valve 32 is closed and is located at a non-zero distance from the applicator assembly 4 received in the site 22. The valve 32 in the closed position is shown on FIG. 7. In this position, the blocking reliefs 48 block the openings 44. No dose of product 8 can therefore come out. Thus, preferably, the valve 32 opens and closes at the dispensing openings 44. This arrangement provides optimum control over the amount of product 8 dispensed on the applicator 4 and minimizes the amount of product 8 which, after dispensing, is exposed to the air on the outer surface of the valve 32. Other valves constructions may nevertheless be suitable. The valve is adapted to the type and rheology of the product 8. Liquid and pasty products can be dispensed with this type of dispensing.

When the dispenser 6 is used for the first time, the channel 34 contains no product 8 and is filled with air. When the push-button 38 is pressed, the pump 36 fills the channel 34 with make-up product 8 via the supply duct 37, and the air contained in the channel 34 is released by the valve 32. In particular, at this stage, the valve 32 does not release any product 8. The push-button 38 must be pressed and released several times to evacuate all the air contained in the channel 34 and replace it by product 8. The product 8 builds up in the closed channel 34. Since the valve 32 is in the closed position at rest, these operations can be performed in the factory.

Once the channel 34 has been filled with product 8 and the user presses the push-button 38 again, since the valve 32 is closed by the wall 42, the pressure of the product 8 is increased. Under the sole pressure of the make-up product 8 filling the channel 34, the wall 42 deforms to open the valve 32. In fact, as the wall 42 lifts up, it moves away from the blocking reliefs 48 of the channel 34. When the openings 44 are no longer blocked, the valve 32 releases product 8 directly against the applicator 4 received in the site 22. More precisely, the valve releases one drop of product through each opening 44 in the wall 42. The valve 32 therefore opens due to the elastic deformation of the wall 42, under the sole pressure of the product 8. Depending on the viscosity, surface tension and hydrophilic/hydrophobic or oleophilic/oleophobic nature of the make-up product 8, the drops of product released by the valve 32 take the shape of a ball or spread over an outer surface of the wall 42.

The valve 32 can deliver product locally in one or more precise areas of the applicator. Thus, the product 8 can be delivered in some areas and not in other areas. The areas loaded with product will therefore be more adapted to deposit the product on the eyelashes, and the areas not loaded to spread the product 8 on the eyelashes and separate the eyelashes. Preferably, the valve 32 can be used to release make-up product 8 only at the free ends of the teeth or protrusions 12 of the applicator 4, in other words the parts of the applicator 4 intended to apply the product 8 on the user. In other words, the product 8 is deposited locally by the valve 32 on the envelope surface formed by the ends of the teeth or protrusions 12 of the applicator 4, or more generally by the surface containing the application head 11 of the applicator 4. Specifically, the rod 10 is not unnecessarily loaded with product, which reduces wastage of the product 8 and prevents it from becoming clogged in this area.

Once the push-button 38 comes up against the control stop 40, the valve 32 is no loner supplied with product 8, the pressure of the product 8 in the channel 34 then drops, and the valve 32 closes.

The invention therefore implements a method for depositing make-up product 8 on the make-up applicator 4 using the product dispenser 6, wherein:

make-up product 8 is released directly against the application head 11 of the applicator 4, received in a receiving site 22 of the applicator 4 provided on the dispenser 6, by opening the outer valve 32 of the dispenser 6 supplied with make-up product 8, and the valve 32 is closed.

The second embodiment of the invention, illustrated on FIGS. 9 and 10, differs from that described above in that the valve 32 is formed by two upper 52 and lower 54 elastic walls, superimposed but spaced apart, the upper wall 52 having at least one dispensing opening 56 and the lower wall 54 having at least one internal opening 58 and at least one blocking relief 60 arranged so that it blocks the dispensing opening 56 when the valve 32 is in the closed position. The dispensing openings 56 are central and elongated. The internal openings 58 have a circular contour and are arranged in a staggered pattern.

A space is formed between the two walls to allow their openings 56, 58 to communicate when the valve 32 is open. In other words, when the valve 32 is open, the product moves successively from the channel 34 to the space through the internal opening(s) 58, then from the space to the outside of the dispenser 6 through the dispensing opening(s) 56. Only the upper wall 52 is deformable to allow the valve 32 to open. The lower wall 54 could be rigid.

The valve 32 opens and closes in the same way as in the first embodiment, in other words under the sole effect of the pressure of the make-up product 8 filling the channel 34.

Obviously, numerous modifications can be made without leaving the scope of the invention.

The applicator could be a curved comb, such as that described in document WO2009032443.

The teeth or protrusions of the applicator can all be the same length or some of them can be longer than the others.

The openings may be arranged in any other different configuration in the wall(s), in particular depending on the structure of the applicator.

If the applicator forms a brush, it can have bristles and/or teeth.

The invention claimed is:

1. Make-up item, comprising:

an applicator whose application head defines an envelope surface;

a dispenser for make-up product, comprising a site for receiving the applicator, and having at least one outer valve provided with at least one dispensing opening which faces a portion of the envelope surface when the applicator is received in the site, the at least one outer valve being able to assume a closed position and an open position wherein the at least one outer valve releases product directly against the application head of the applicator; and a channel adapted to be filled with the make-up product, wherein the at least one outer valve is formed by at least two upper and lower elastic walls, superimposed but spaced apart, an upper elastic wall of the at least two upper and lower elastic walls having the dispensing opening and a lower wall of the at least two upper and lower elastic walls having at least one internal opening and at least one blocking relief arranged so that the at least one blocking relief blocks the dispensing opening when the at least one outer valve is in the closed position.

2. Make-up item according to claim 1, arranged so that the at least one outer valve opens and closes at the dispensing opening(s).

3. Make-up item according to claim 1, wherein the at least one outer valve is arranged so that when in the closed position, the at least one outer valve is located away from the applicator received in the site.

4. Make-up item according to claim 1, wherein the dispenser further comprises a flexible pouch for storing the make-up product, this flexible pouch being housed in a rigid container mounted movably relative to the at least one outer valve.

5. Make-up item according to claim 1, wherein the dispenser further comprises a pump, without air intake, for supplying the at least one outer valve with the make-up product.

6. Make-up item according to claim 1, wherein the dispenser further comprises an outer member for controlling the at least one outer valve, this control member being associated with a stop for controlling a supply of the at least one outer valve with the make-up product.

7. Make-up item according to claim 1, wherein the at least two upper and lower elastic walls are arranged so that they deform to open the at least one outer valve under a sole pressure of the make-up product filling the channel.

8. Method for depositing make-up product on a make-up applicator of a make-up item using a product dispenser, wherein:

make-up product is released directly against an application head of the make-up applicator, the release of the make-up product including filling a channel of the make-up item with the make-up product, opening at least one outer valve of the product dispenser under an effect of a pressure of the make-up product filling the channel, wherein the at least one outer valve is provided with at least one dispensing opening, and wherein the at least one outer valve is formed by at least two upper and lower elastic walls, superimposed but spaced apart, an upper elastic wall of the at least two upper and lower elastic walls having the dispensing opening and a lower elastic wall of the at least two upper and lower elastic walls having at least one internal opening and at least one blocking relief arranged so that it blocks the dispensing opening when the at least one outer valve is in a closed position, releasing make-up product directly against the application head of the make-up applicator, and closing the at least one outer valve.

* * * * *